US006608595B1

(12) United States Patent
Louzir

(10) Patent No.: US 6,608,595 B1
(45) Date of Patent: Aug. 19, 2003

(54) TELECOMMUNICATION DEVICE WITH SHAPED ELECTRONIC SCANNING ARRAYS AND ASSOCIATED TELECOMMUNICATION TERMINAL

(75) Inventor: Ali Louzir, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/869,457

(22) PCT Filed: Dec. 30, 1999

(86) PCT No.: PCT/FR99/03319

§ 371 (c)(1),
(2), (4) Date: Sep. 25, 2001

(87) PCT Pub. No.: WO00/41265

PCT Pub. Date: Jul. 13, 2000

(30) Foreign Application Priority Data

Dec. 31, 1998 (FR) ..... 98 16741

(51) Int. Cl.[7] ..... H01Q 1/38
(52) U.S. Cl. ..... 343/700 M; 342/374
(58) Field of Search ..... 342/371, 374; 343/700 MS, 853

(56) References Cited

U.S. PATENT DOCUMENTS

| | | | | |
|---|---|---|---|---|
| 3,940,770 A | | 2/1976 | Fassett et al. | 343/754 |
| 4,101,895 A | | 7/1978 | Jones, Jr. | 343/708 |
| 4,605,932 A | | 8/1986 | Butscher et al. | 343/700 |
| 4,980,692 A | | 12/1990 | Rudish et al. | 343/700 |
| 5,216,430 A | | 6/1993 | Rahm et al. | 343/700 |
| 5,650,788 A | | 7/1997 | Jha | 343/700 |
| 6,016,123 A | * | 1/2000 | Barton et al. | 342/374 |

FOREIGN PATENT DOCUMENTS

| | | | |
|---|---|---|---|
| EP | 0512487 | 11/1992 | H01Q/21/20 |
| FR | 2764140 | 12/1998 | H04B/7/26 |

* cited by examiner

*Primary Examiner*—Michael C. Wimer
(74) *Attorney, Agent, or Firm*—Joseph S. Tripoli; Kuniyuki Akiyama

(57) ABSTRACT

The invention relates to a telecommunications device with an electronic scanning array shaped according to a first surface with rotational symmetry, comprising: a first array of first radiating sources arranged over the said first surface in order to operate about a first central frequency. According to the invention, the device comprises, in addition: a second array of second radiating sources arranged over a second surface with rotational symmetry adjacent to the said first surface in order to operate about a second central frequency, the first and second sources being placed such that a first source and a second source do not face a second source and a first source respectively, along a section normal to the first and second surfaces pointing to the first source and the second source respectively. The invention also relates to a telecommunications terminal in a satellite constellation system and to a wireless communications terminal for communicating with domestic appliances comprising a device according to the invention.

9 Claims, 6 Drawing Sheets

Figure 1:
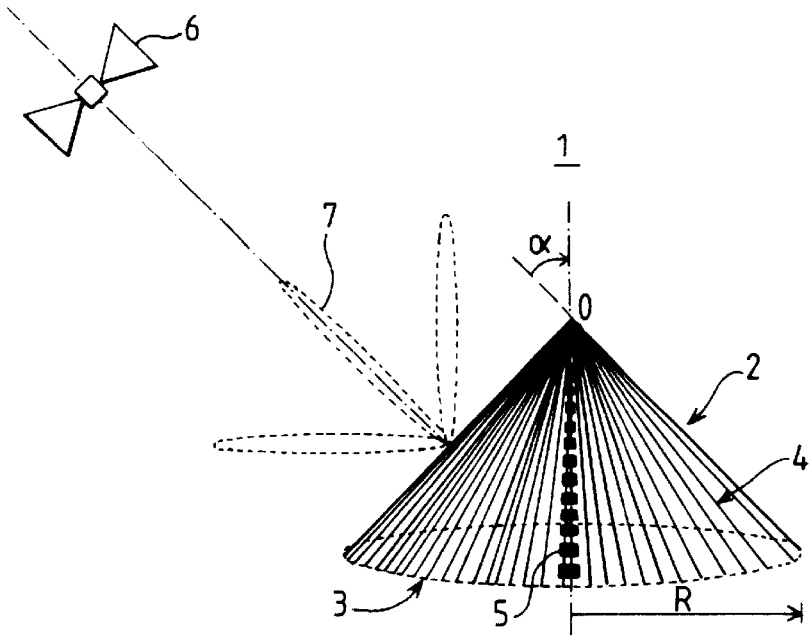

TELECOMMUNICATION DEVICE WITH SHAPED ELECTRONIC SCANNING ARRAYS AND ASSOCIATED TELECOMMUNICATION TERMINAL

This application claims the benefit of French application serial no. 9816741 filed Dec. 31, 1998, which is hereby incorporated herein by reference, and which claims the benefit under 35 U.S.C. § 365 of International Application PCT/FR99/03319, filed Dec. 30, 1999, which was published in accordance with PCT Article 21(2) on Jul. 13, 2000 in French.

The present invention relates to the field of telecommunications, especially microwave telecommunications, and relates more particularly to a telecommunications device with shaped electronic scanning arrays. It also relates to a telecommunications terminal in a satellite constellation system and to a wireless communications terminal for communicating with domestic appliances.

Hitherto, commercial telecommunications via satellite have been achieved almost entirely by geostationary satellites, which are particularly beneficial because of their unchanging relative positions in the sky. However, a geostationary satellite has major drawbacks such as considerable attenuations of the transmitted signals which are associated with the distance separating the user antennas of the geostationary satellite (about 36,000 kilometers, the corresponding losses then rising to about 205 dB in the Ku band) and transmission lags (typically about 250 ms to 280 ms) thus becoming clearly perceptible and annoying, especially for real-time applications such as telephony, video conferencing, etc. Furthermore, the geostationary orbit, located in the equatorial plane, poses a visibility problem for regions at high latitude, the angles of elevation becoming very small for the regions close to the poles.

The alternatives to employing geostationary satellites are:

- the use of satellites in inclined elliptical orbit, the satellite then being almost stationary above the region situated at the latitude of its apogee for a duration of possibly up to several hours,
- the implementation of satellite constellations in circular orbit, in particular in low orbit ("Low Earth Orbit" or LEO) or in mid-orbit ("Mid Earth Orbit" or MEO), the satellites of the constellation flying past in turn within visibility of the user terminal for a duration of from some ten minutes to around one hour.

In both cases, the service cannot be provided permanently by single satellite, continuity of service demanding that several satellites fly over the service area one after another.

Document EP 0 598 656 A1 describes a frustoconical array antenna comprising elements radiating along cone generatrices. Such an antenna is intended for the tracking of targets. However, this antenna is only able to operate in a single frequency band.

The aim of the invention is to remedy the problem of the prior art.

To this end, the subject of the invention is a telecommunications device with electronic scanning arrays shaped over a first surface with complete or partial rotational symmetry, comprising:

- a first array of first radiating sources arranged over the said first surface area in order to operate about a first central frequency, characterized in that, in addition, the said device comprises:
- a second array of second radiating sources arranged over a second surface with rotational symmetry adjacent to the said first surface in order to operate about a second central frequency,
- the first and second sources being placed such that a first source and a second source do not face a second source and a first source respectively, along a section normal to the first and second surfaces pointing to the first source and the second source respectively.

Thus the invention makes it possible to operate about two central frequencies and can be shaped according to its application. Such a configuration of radiating sources of the two facing arrays makes it possible to minimize the interactions between the facing sources. The invention has the advantage of proposing a device operating about two central frequencies (which amounts to having two different antennas) for virtually the same physical surface. In addition, the process for manufacturing the substrate forming the surface associated with such a device is simple since it only requires the formation of two flat substrates of surface areas corresponding to the deployment of the said first and second surfaces.

According to one embodiment, for each array corresponding to the said surfaces, the radiating sources are arranged according to M respective alignments linking a point oriented towards radiation space to a base opposite to the said point.

According to one embodiment, the said first and second surfaces are conical or partially conical. In this way, the device according to the invention makes it possible to track a moving element wherever it is in the radiation field of the device. Its conical shape means it is possible to cover a solid receiving angle of 360° in azimuth and of 90° in elevation.

In the present application, the term "elevation" refers to an angle between the satellite and the local horizon while the term "azimuth" corresponds to a movement of the satellite in the plane orthogonal to the elevational movement determining an angle connecting the satellite to a local reference vertical.

When tracking a moving element by the device along the azimuthal plane, in order for steady tracking to be possible, at a current time t, on each array, the N alignments fed by the switch have N−1 alignments common with those fed at the previous feed time, a new feed time being defined by modifying the feed of at least one of the N alignments.

According to one embodiment, the radiating surface of each radiating source increases with the distance, along the alignment to which the said source belongs, separating the said radiating source from the said point, which makes it possible inter alia to compensate for the loss in signal level during its trajectory along the alignment.

According to one embodiment, the or one of the characteristic dimensions of the radiating surface of each radiating source and perpendicular to the corresponding alignment increases with the distance, along the alignment to which the said source belongs, separating the said radiating source from the said point.

According to one embodiment, the device according to the invention comprises, for each array corresponding to the said surfaces, first phase shifters combined with each source to control the phases of the said alignments relative to the sources.

According to one embodiment, the device according to the invention comprises:

- a switch coupling the said 2M alignments of the said first and second arrays to N lines of an array of combiners/dividers, where N<M, the said switch being capable of feeding N adjacent alignments of each array of sources at a given instant, a controller to control the switch and the first phase shifters in order to tilt the radiation pattern resulting from the said 2N alignments along a first azimuthal direction and a second elevational direction, respectively.

In operation, on each array, the radiation from the surface formed by the array of N activated alignments does not correspond to that of a flat array, but to that of a curved array. Consequently, second phase shifters each control an additional phase shift of the N fed alignments, the said phase shift varying according to a phase gradient such that each source of N fed alignments is fed in an equiphase manner. Thus, the gain is optimized and the rise of the secondary lobes is reduced.

According to one embodiment, in order to communicate with a moving element, groups of N adjacent alignments are fed successively on each array of sources, each group being differentiated by a single alignment when tracking the said element.

According to one embodiment, each alignment comprises a succession of radiating sources, two radiating sources being separated by a first phase shifter.

According to one embodiment, one and the same phase shifter is common to several alignments such that it can adjust the phase of several sources.

According to one embodiment, one of the said first or second arrays is adapted to receive signals and the other of the said first or second arrays is adapted to transmit signals, such that the said device is able to operate in bidirectional mode.

According to one embodiment, the radiating sources comprise radiating patches.

The subject of the invention is also a telecommunications terminal in a satellite constellation system, characterized in that it comprises a device according to the invention above.

According to one embodiment, in order to continually exchange signals with a satellite over time, the said controller comprises storage means comprising a table of positions with time of a plurality of satellites of the satellite system. Since this solution is purely electronic, there is no scope for switching lags when switching reception from a first satellite to another.

According to one embodiment, each satellite position, at a given instant, in radioelectric radiation space of the device has corresponding co-ordinates (N, $\Delta\Phi$), where N corresponds to N adjacent alignments to one and the same array fed by the said switch and $\Delta\Phi$ represents the phase shift introduced by the said first phase shifters to the sources of the N alignments.

According to one embodiment, the controller is connected to the receiving circuit of the device in order to measure a quality parameter of the received signal. Thus, where the quality parameter is not complied with, the controller controls the exchange of signals with a satellite of known position in radiation space where the quality criterion for the received signal is fulfilled. For example, the quality criterion is the level of signal received. According to another variant, the quality criterion can be the error rate detected in a demodulator located in an internal unit to which the processing circuit is connected.

The subject of the invention is also a wireless communications terminal to communicate with domestic appliances, characterized in that it comprises a device according to the invention.

Figure 3:
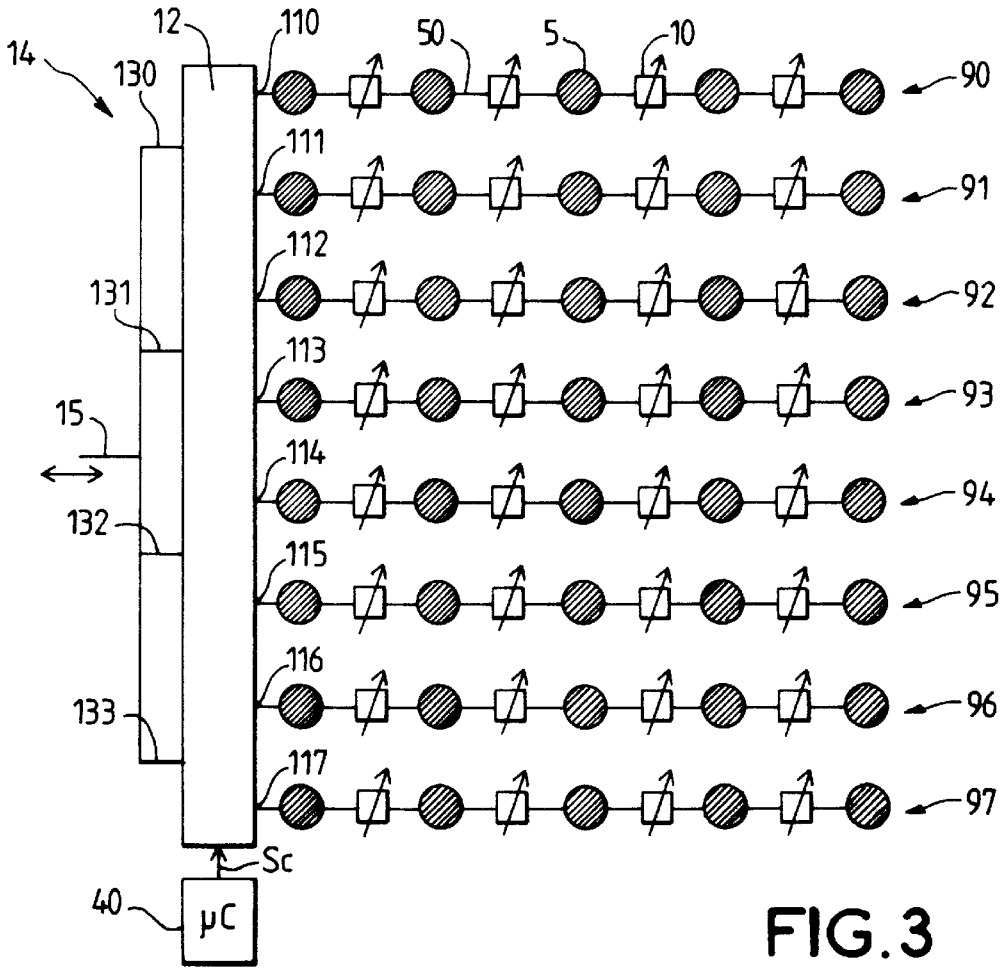
Figure 2A:
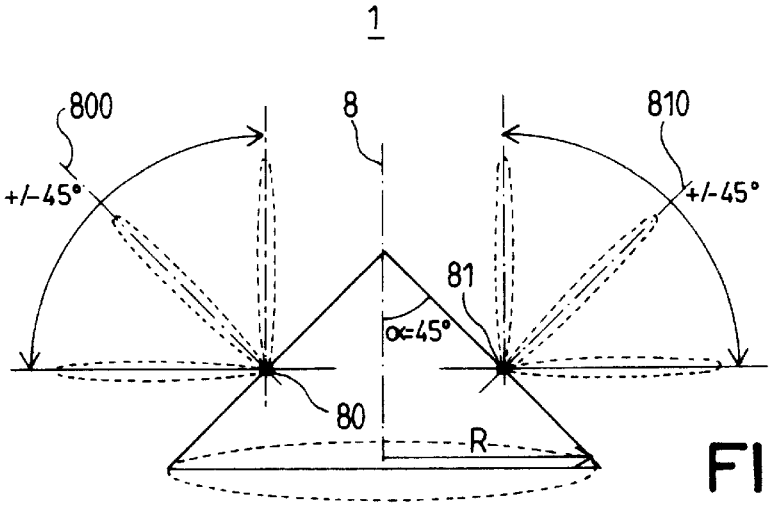
Figure 2B:
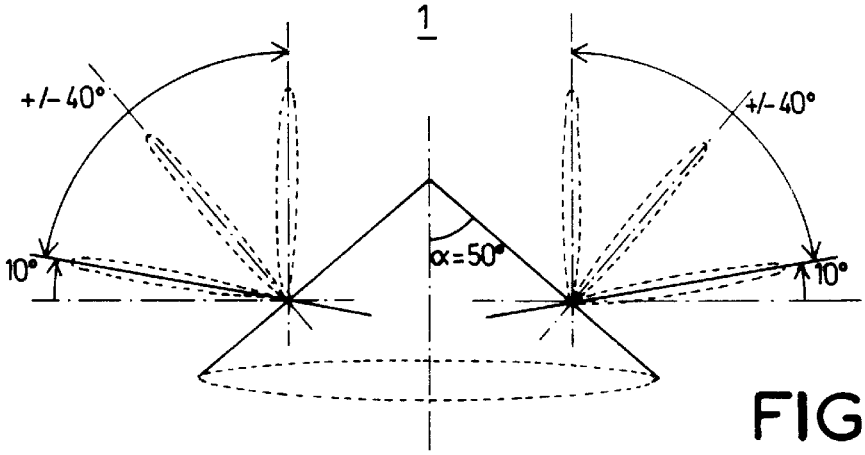
Figure 2C:
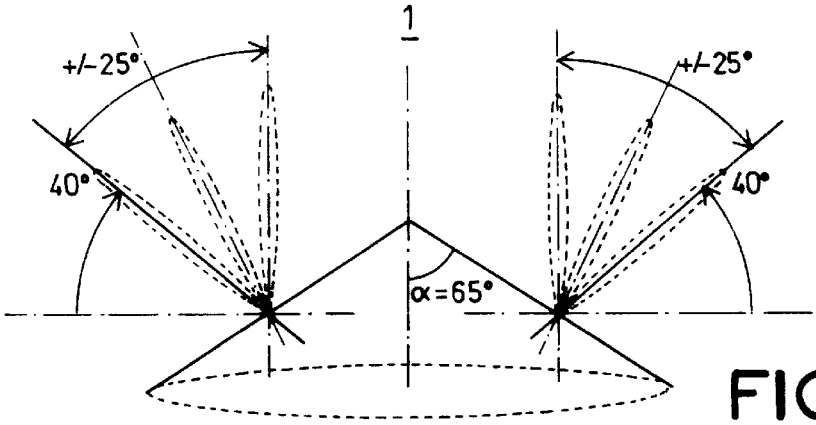
Figure 4A:
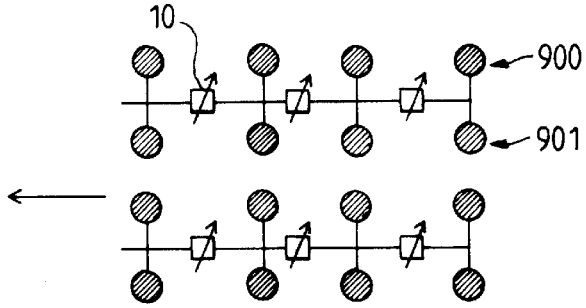
Figure 4B:
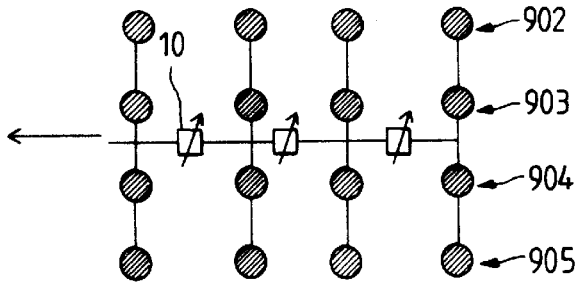
Figure 5A:
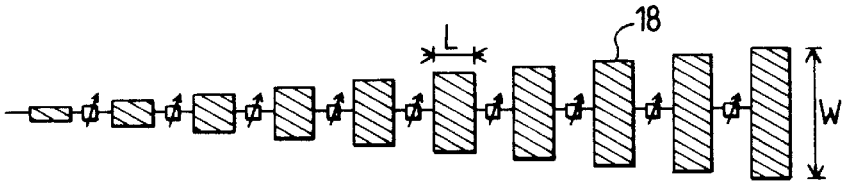
Figure 5B:
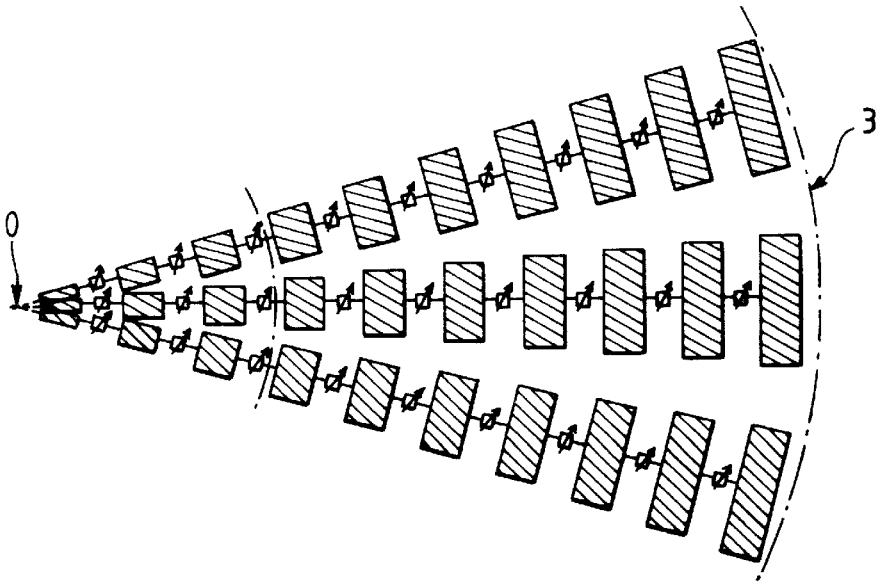
Figure 6:
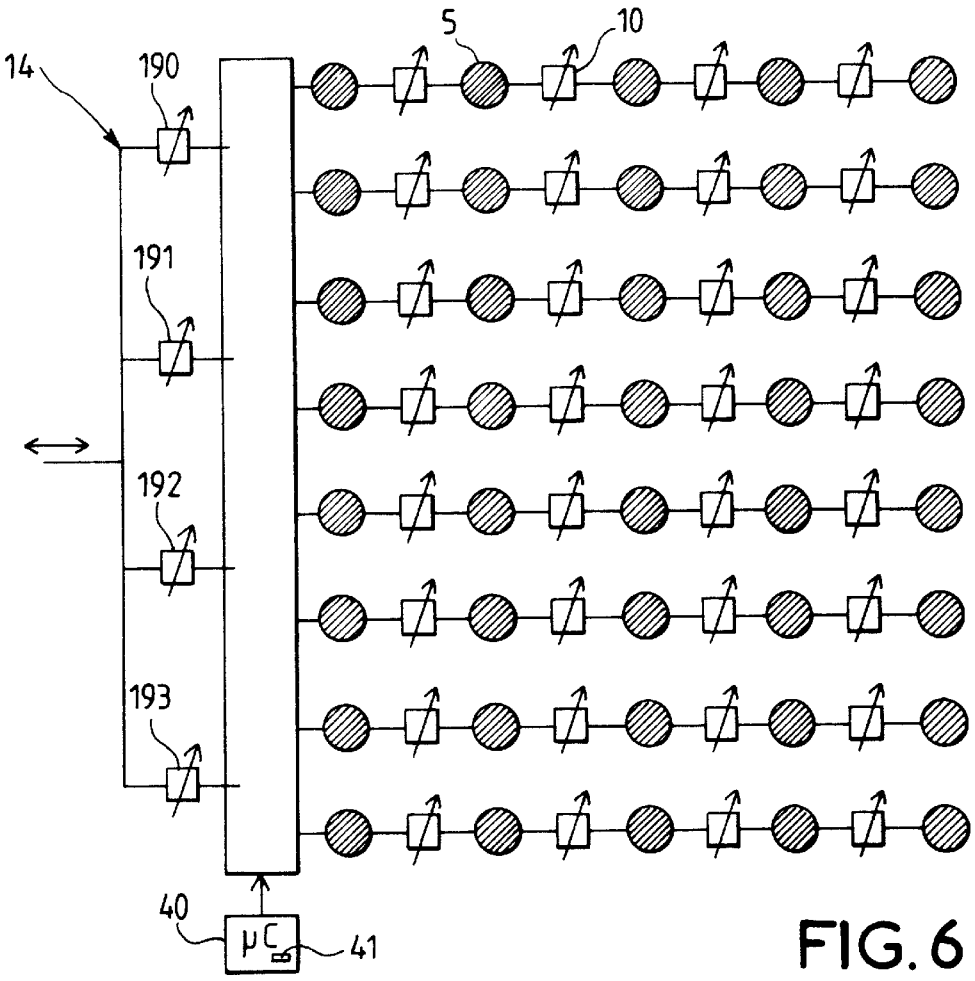
Figure 8:
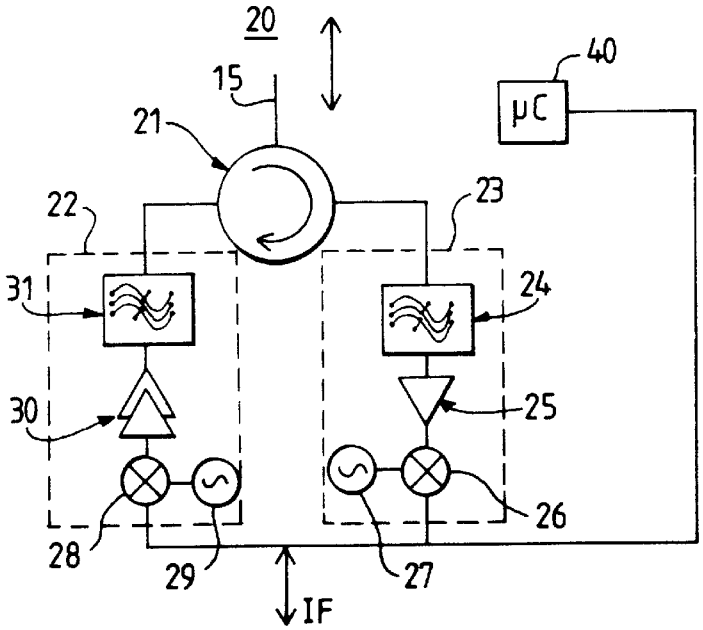
Figure 7:
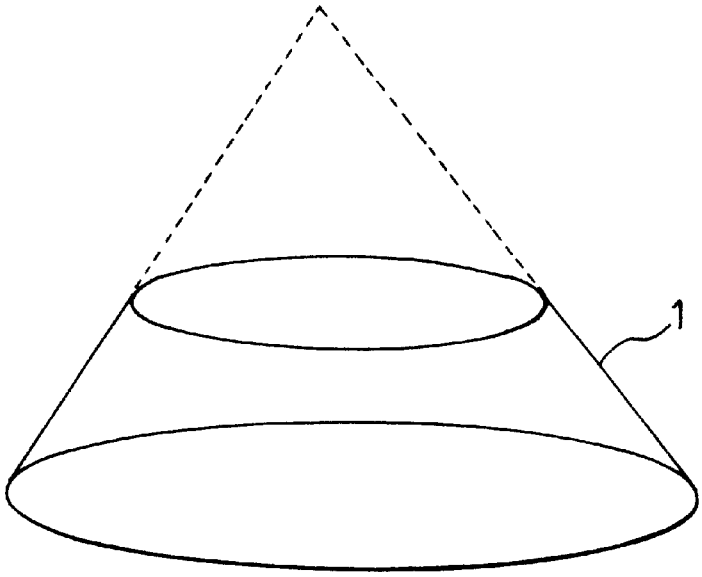
Figure 9:
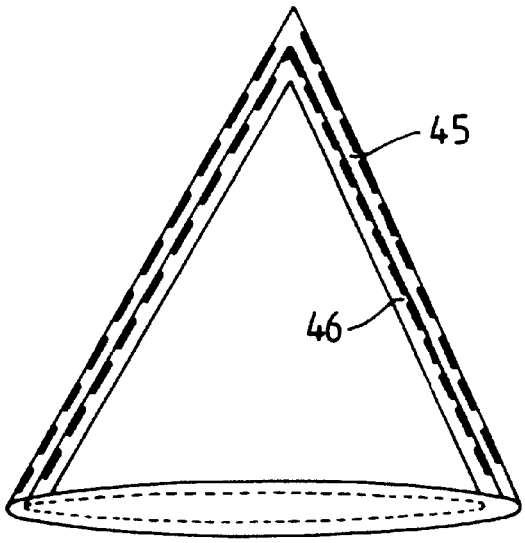
Figure 10A:
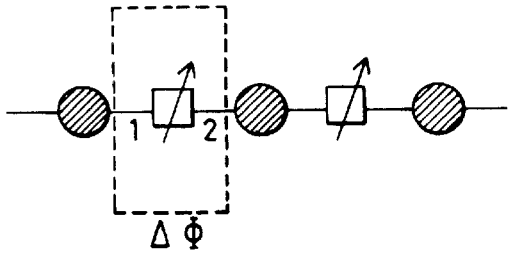
Figure 10B:
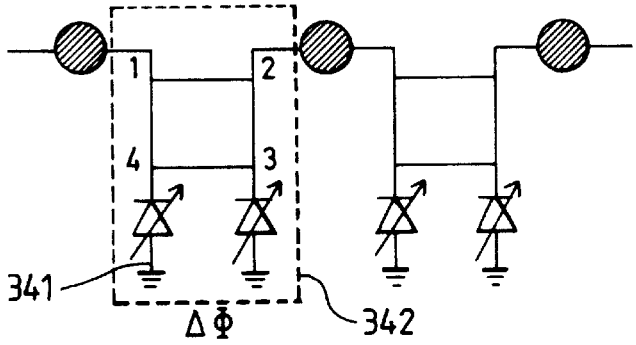
Figure 10C:
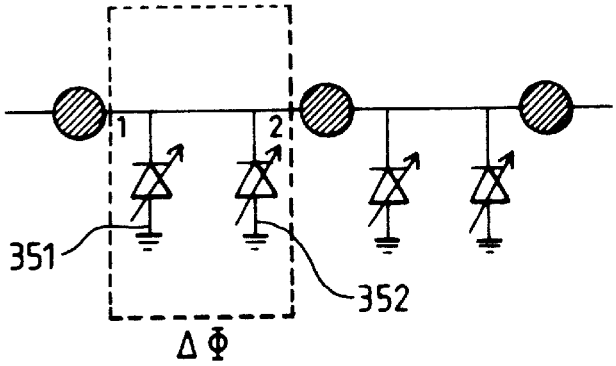

Other characteristics and advantages of the present invention will emerge from the description of the exemplary embodiments and variants which will follow, taken by way of non-limiting examples, with reference to the appended figures in which:

FIG. 1 shows a perspective diagram of a device according to the invention,

FIG. 2.*a* shows one embodiment of the device according to the invention while FIGS. 2.*b* and 2.*c* show variants of the embodiment of FIG. 2.*a* according to different specifications for the satellite system, FIG. 3 shows a plurality of alignments according to one embodiment of the invention, FIGS. 4.*a* and 4.*b* show schematic variants of the embodiment of FIG. 3, FIG. 5.*a* shows a variant of the embodiment of an alignment according to the invention while FIG. 5.*b* shows a succession of alignments according to this variant, FIG. 6 shows a variant of the embodiment of FIG. 3, FIG. 7 shows a variant of the device according to the invention, FIG. 8 shows an embodiment of a signal transmission/reception circuit according to the invention, FIG. 9 shows a variant of the device according to the invention, FIG. 10.*a* shows schematically the first phase shifters according to the invention while FIGS. 10.*b* and 10.*c* show embodiments of these phase shifters.

In order to simplify the description, the same references will be used in the above figures to denote elements fulfilling identical functions.

FIG. 1 shows a perspective diagram of a device 1 according to the invention. The latter comprises a conical substrate 2 with apex O, apex half-angle $\alpha$ and radius R on its circular base 3. The substrate itself rests on a conical support (not shown). In this figure, a plurality of generatrices 4 have been illustrated, connecting the apex O with the base 3 along a plane normal to this base. For reasons of clarity, radiating patches 5 are only illustrated on one of the generatrices 4, the whole array of radiating patches on one generatrix forming an alignment while all the alignments are arranged on the envelope of the cone to cover a radiation field of 360°. For fuller details of the alignments, reference may be made to the work "Techniques de l'Ingénieur" [Engineering Techniques] E3280 Antennes [Antennas], Chapter 3: Alignements [Alignments]. In FIG. 1, the device 1 picks up the signals coming from a satellite 6 according to a pattern 7. In the configuration shown, the device 1 picks up the satellite without elevational deviation of its radiation pattern 7. The maximum deviation of this pattern, illustrated in dotted lines, is defined by the characteristics of the device such that the latter has an elevational angle for picking up satellites going from 0° to 90°. The elevational deviation is defined by a phase shift of the radiation pattern for a given group of fed alignments.

FIG. 2.*a* shows schematically one embodiment of the device according to the invention. According to the specifications for this first embodiment, the device has to cover a radiation field with respect to the horizontal from 0° to 90° in elevation. In this context, the angle $\alpha$ is calculated at 45°. In this way, the phase center arrays 80, 81 undergo a phase shift allowing a deviation going from −45° to 45° with respect to optimal sighting axes without respective deviation 800, 810.

FIGS. 2.*b* and 2.*c* show variants of the embodiment of FIG. 2.*a* according to different specifications for the non-synchronous satellite system. For FIG. 2.*b*, where the system specification allows a satellite pick-up angle of 10° at the local horizon, the angle $\alpha$ is 50° while, in FIG. 2.*c*, where the satellite system comprises a large number of satellites flying along predefined trajectories, thus ensuring that there are several satellites in radiation space at a given instant, the minimum pick-up angle with respect to the local horizon can be set at 40°, leading to an angle α of 65°.

FIG. 3 shows a plurality of alignments 90, 91, . . . 97 in an array of circular radiating patches 5, two adjacent patches 5 being separated by an adjustable phase shifter 10. Note that, in the following, only elements of one array corresponding to the same surface 45, 46 (see FIG. 9) will be described, the description of the second array being identical as to its construction, only the positioning of the patches facing each array is explained in the following. In this case, the array which will be described will be that used for receiving signals. The second array used for transmitting signals will not be described but its construction remains the same as that of the receiving array (radiating patches, phase shifters, connections to a switch using connectors 110, . . . 117 described below). Each alignment 90, 91, . . . 97 has two ends, one comprising a radiating patch and the other comprising a radiating patch connected to connectors 110, 111, . . . 117, respectively, of a switch 12. The switch is connected to a combiner/divider 14 by four feed lines (N=4) 130, 131, 132, 133. By virtue of a control signal Sc coming from a microcontroller 40, the switch 12 makes it possible to feed four alignments, for example 90 to 93, from among the seven (M=7) alignments of the array. It should be stressed that only a limited number of patches and alignments have been shown for purposes of clarity of the drawings, but the number of alignments is about a hundred. The selection of these four alignments 90 to 93 is carried out according to a pre-established selection method on the basis of a table contained in a read-only memory 41 and comprising an ephemeris of satellite positions over time and/or by taking the level of signals received on the receiving circuit into account. In this last case, the microcontroller has a threshold value in a read-only memory. On receiving signals whose level drops below the threshold value, the microcontroller orders four adjacent alignments, for example 91 to 94, to be fed. In any case, it is necessary that three of the alignments selected are from the alignments previously fed in order to allow steady and smooth tracking. If the radiation pattern generated by these four alignments does not allow reception at a suitable level, the microcontroller continues its switching in a circular manner towards four other adjacent alignments until the required condition of a level greater than the threshold value is fulfilled. Of course, the method for selecting the N alignments is not limited to the methods described above and can be extended to any other method. The four fed alignments are connected to four lines 130 to 133 of the combiner/divider, the output/input of which is connected by a link 15 to a transmitting/receiving circuit described below. Each alignment 90 to 97 is placed on the surface of the cone 2 along a generatrix 4 thereof. The patches are excited by the feedlines 50, the patches and the lines 50 being etched on the top surface of the substrate oriented towards the radiation space of the device. Of course, by using two layers of substrate, the patches and the excitation lines can be etched on opposite faces.

FIGS. 4*a*. and 4.*b* show variants of the embodiment of FIG. 3. In FIG. 4.*a*, the same phase shifter 10 is common to two alignments 900, 901 while in FIG. 4.*b*, the same phase shifter 10 is common to four alignments 902, 903, 904, 905. The alignments 90, 91, . . . 97 can be fed, according to FIG. 4.*a*, by groups of two alignments or, according to FIG. 4.*b*, by groups of four, or more. This makes it possible to reduce the total number of phase shifters in the array (typically, this number is divided by two, four, etc. and generally divided by i), since two, four (and generally i) patches belonging to adjacent alignments have their phase adjusted by the same phase shifter. Bringing alignments together in this way also makes it possible to reduce the number of ports 110 to 117, which reduces the complexity and a fortiori the cost of the switch. The switch, initially comprising M ports for the receiving array for M alignments of the sources of the receiving array (M other ports being intended for the connections of M alignments of the sources of the transmitting array) and N ports for the lines connected to the combiner/divider, may, by virtue of the invention, bear only m ports for the M alignments and n ports for the lines connected to the combiner/divider where m and n are such that: m<M, m=M/k, and n<N, and n=N/k with k=2, 4, . . . i.

FIG. 5.*a* shows another variant of an alignment of patches 18. Each patch 18 is rectangular, of constant height L along the height of the cone 2 and of width W which increases, according to a predefined law, for example linearly, as an inverse function of the distance of the patch from the base 3 of the cone. The constancy of the height L for the same surface makes it possible for the patches to operate at the same frequency. Furthermore, the reduction of the width W, as mentioned above, makes it possible:

- for the patches of the same array which are close to the apex not to be too close to each other, thus minimizing interference,
- for the patches of the same array close to the apex to be spaced out enough that they are not facing patches of the second array along a section normal to the surfaces comprising the sources.

FIG. 5.*b* shows a series of alignments of patches 18 according to the variant of FIG. 5.*a*. This series is placed on a plane before being shaped into a cone.

FIG. 6 shows a variant of FIG. 3. In FIG. 6, between each line 130, 131, 132, 133 and each corresponding input/output connector of the combiner/divider 14, there is a phase shifter 190, 191, 192, 193 which allows an additional adjustment of the phases corresponding to each alignment or group of alignments with which it is associated. This adjustment is controlled by the microcontroller 40.

According to a variant of the invention illustrated in FIG. 7, the device 1 has a frustoconical shape. This configuration is beneficial for small angles of elevation. It is also better adapted to keep the distances between patches belonging to two adjacent alignments almost constant. This is because, for a conical device, the radiating patches close to the apex O suffer from being close to each other compared to those close to the base.

FIG. 8 shows one embodiment of a transmitting/receiving circuit 20 connected to the combiner/divider 14 of FIG. 3. The latter comprises a circulator 21, one input of which is connected to a signal transmission circuit 22, one output of which is connected to a signal receiving circuit 23 and one input/output of which is connected to the combiner/divider 14 via the line 15. The receiving circuit 23 comprises, successively, in the direction of signal reception, a bandwidth receiving filter 24 filtering around the central receiving frequency, a low-noise amplifier 25, a mixer 26 receiving, at a first input, the signal filtered by the filter 24 and amplified by the amplifier 25 and, at a second input, an output signal from a local oscillator 27. The output of the mixer supplies an intermediate-frequency signal for an internal unit of a dwelling (not shown) on which the transmission/reception device according to the invention is placed. The transmitting circuit 22 comprises, in the direction of signal transmission, a mixer 28, a first input of which receives an intermediate-frequency signal from the internal unit, a second input coming from a local oscillator 29 transposing the input signal of the mixer onto the transmission frequency. The output signal of the latter drives the input of a power amplifier 30. The output of the amplifier is connected to the input of a bandwidth transmission filter 31 filtering the said signal around the transmission frequency in order to deliver it to the input of the circulator 21. Thus, the circuit 23 is a circuit for converting to intermediate frequency while the circuit 22 is a circuit for converting to transmission frequency, generally to microwave frequencies. The output of the mixer 26 delivering the signal at intermediate frequency for the internal unit is also connected to the microcontroller 40 which uses the received signal to detect its level, as explained above. Thus, the circuit 20 makes it possible to receive reception signals coming from the first receiving array described above and to pass signals to be transmitted to the second array.

This superposition of several layers of substrates is implemented with several aims:

with a view to being able to receive two satellites simultaneously. According to this variant, an array may be dedicated to the reception/transmission of signals relative to a first satellite while the second is dedicated to the reception/transmission of signals relative to a second satellite. As mentioned above, it is necessary that the patches of each of the surfaces are not superimposed, such that the patches of the upper surface do not disturb the transmission/reception of signals from patches of the lower surface, one surface may be dedicated to transmission and the second to reception, as previously envisaged. In this case, the circulator is not used but there are two means of direct access: one to transmission and one to reception. This makes it possible to separately optimize each array (central operating frequency, width of the band, radiation pattern, etc.). Likewise, in order to reduce the coupling between transmission and reception, the patches are not superimposed in this case.

According to a variant described in FIG. 9, with the aim of broadening the bandwidth of the device according to the invention, an auxiliary array also comprising radiating patches is associated with each array (respectively first and second array), called the main array. The same main array has been represented by a pair of layers. Patches superimposed on the patches of the lower layer 46 are etched on the upper layer (called surface layer) of substrate 45 (without earth plane). Each array of patches of the upper substrate resonates about a central frequency which is slightly offset from that of the array which it is facing, in order that the operating frequency bandwidth of the array pair consisting of two facing principal and auxiliary arrays can be broadened.

FIG. 10.*a* illustrates, surrounded by dotted lines, a phase shifter 10 with connectors 1, 2, to diodes, for controlling the phase shift $\Delta\Phi$ between the patches of an alignment, which sets the deviation of the beam in elevation $\theta$, such that:

$$\Delta\theta=2\Pi d^* \sin\theta/\lambda$$

FIG. 10.*b* is one embodiment of this phase shifter. This comprises identical variable capacitance or "varactor" diodes 341, 342 placed at the ports 3, 4 of a 3 dB/90° hybrid coupler. The microcontroller varies the bias voltage of these diodes, which modifies the junction capacitance of the diodes and therefore their reflection coefficient. The phase shift between the ports 1 and 2 is thereby modified. Thus, the microcontroller continuously controls the phase variations of the phase shifters.

FIG. 10.*c* shows another embodiment of the phase shifter: it comprises two varactor diodes 351, 352 placed on the transmission line between the ports 1 and 2 and the phase shift between the ports 1 and 2 is controlled by the bias voltage of these diodes.

The device according to the invention may be advantageously, but not exclusively, used for receiving and/or transmitting in a satellite communications system, especially a non-synchronous satellite communications system or in a home-automation system for the connection between various domestic appliances.

Of course, the invention is not limited to the embodiments and variants described. Thus the device 1 according to the invention has been described about a conical surface 2. Any other surface with rotational symmetry can be envisaged. Furthermore, a surface 2 with rotational symmetry truncated along at least one section normal to the surface passing through the central surface axis is also conceivable. In this scenario, the rotation is therefore no longer total at 360° but will be partial.

What is claimed is:

1. Telecommunications device with electronic scanning arrays of the type comprising M first alignments of first radiating sources in arrays, the said sources being aligned along a generatrix of a surface of revolution, and a switch coupling the said M alignments to N lines of an array of combiners/dividers, where N<M, the said switch being controlled to feed N alignments amongst said M alignments at a given instant, said N alignments being chosen to be adjacent, said device comprising, in addition, phase shifters inserted between the radiating sources of the same generatrix and a controller to control the switch and the phase shifters so as to adjust the radiation pattern resulting from the said N alignments according to a first azimuthal direction and a second elevational direction, respectively.

2. Device according to claim 1, wherein the radiating sources are formed by patches etched on a substrate forming the said surface of revolution and directly excited by printed lines which are on the same plane as the said patches.

3. Device according to claim 1, wherein the radiating surface of each radiating source increases with the distance separating the said source from the coupling point of the alignment to which the said source belongs with the said switch.

4. Device according to claim 1, wherein the dimensions of each radiating source are determined such that, along one alignment, it operates at the same predetermined central frequency.

5. Device according to claim 1, wherein one and the same phase shifter is common to several alignments such that it can adjust the phase of several sources.

6. Device according to claim 1, wherein second phase shifters each control an additional phase shift of N fed alignments, the said phase shift varying according to a phase gradient such that each source of N fed alignments is fed in an equiphase manner.

7. Device according to claim 1, wherein the surface of revolution consists of a cone or of a truncated cone.

8. Device according to claim 2, wherein, in addition, it comprises M' second alignments of second radiating sources placed on a second substrate superimposed on the first substrate, the said first and second sources being placed such that they do not face each other, the second alignments of the second radiating sources operating at a central frequency different from that of the first alignments of the first radiating sources.

9. Device according to claim 1, wherein, groups of N alignments are fed successively in time, each group being differentiated by a single alignment.

* * * * *